US008267843B2

(12) United States Patent
Dellino

(10) Patent No.: US 8,267,843 B2
(45) Date of Patent: Sep. 18, 2012

(54) GLUTEUS WEIGHT TRAINING MACHINE

(75) Inventor: Fabio Dellino, Bellaria-Igea Marina (IT)

(73) Assignee: Fabio Dellino, Bellaria-Igea Marina, Rimini (IT)

( * ) Notice: Subject to any disclaimer, the term of this patent is extended or adjusted under 35 U.S.C. 154(b) by 81 days.

(21) Appl. No.: 12/750,332

(22) Filed: Mar. 30, 2010

(65) Prior Publication Data

US 2011/0245047 A1 Oct. 6, 2011

(51) Int. Cl.
*A63B 21/00* (2006.01)

(52) U.S. Cl. ..... 482/137; 482/100; 482/133; 482/138

(58) Field of Classification Search ..... 482/56, 482/100, 133–138, 142, 143, 144
See application file for complete search history.

(56) References Cited

U.S. PATENT DOCUMENTS

| | | | | | |
|---|---|---|---|---|---|
| 4,502,681 | A * | 3/1985 | Blomqvist | 482/130 |
| 4,986,261 | A * | 1/1991 | Iams et al. | 601/35 |
| 5,066,003 | A * | 11/1991 | Jones | 482/137 |
| 5,215,511 | A * | 6/1993 | Cheng | 482/121 |
| 5,277,684 | A * | 1/1994 | Harris | 482/130 |
| 5,445,583 | A * | 8/1995 | Habing | 482/52 |
| 5,593,374 | A | 1/1997 | Gvoich | |
| 5,616,111 | A * | 4/1997 | Randolph | 482/133 |
| 5,709,633 | A * | 1/1998 | Sokol | 482/62 |
| 6,120,416 | A * | 9/2000 | Walker | 482/57 |
| 6,135,930 | A * | 10/2000 | Kuo | 482/72 |
| 6,468,188 | B1 | 10/2002 | Koenig | |
| 6,533,710 | B2 * | 3/2003 | Lin et al. | 482/123 |
| 6,605,024 | B2 | 8/2003 | Stearns | |
| 6,652,430 | B2 | 11/2003 | Lapcevic | |
| 6,676,573 | B2 | 1/2004 | Abelbeck | |
| 6,679,812 | B2 | 1/2004 | Torkelson | |
| 6,764,431 | B2 * | 7/2004 | Yoss | 482/56 |
| 6,802,800 | B1 | 10/2004 | Hobson | |
| 6,962,554 | B2 * | 11/2005 | Keiser | 482/112 |
| 7,029,426 | B1 | 4/2006 | Fuller | |
| 7,442,153 | B1 * | 10/2008 | Chasnov | 482/142 |
| 7,473,212 | B2 | 1/2009 | Simmons | |
| 7,806,815 | B2 * | 10/2010 | Fernandez et al. | 482/140 |
| 7,967,733 | B2 * | 6/2011 | Abelbeck | 482/51 |
| 2002/0128125 | A1 | 9/2002 | Simmons | |
| 2004/0209745 | A1 | 10/2004 | Riney | |
| 2006/0100070 | A1 * | 5/2006 | Abdo | 482/121 |
| 2007/0037673 | A1 | 2/2007 | Giannelli | |

* cited by examiner

*Primary Examiner* — Allana Lewin
(74) *Attorney, Agent, or Firm* — Los Angeles Patent Group; Arman Katiraei

(57) ABSTRACT

Some embodiments provide a gluteus weight training machine for progressive overload resistance training of the gluteus muscles. The gluteus weight training machine includes a frame, a support member linked to the frame, and two resistance members that provide resistance against a downward arcing rotation of the resistance member. Each resistance member includes a pad against which a user's leg applies force in order to perform the downward arcing rotation of the resistance member. Each resistance member further includes a weight assembly that adjusts the amount of weight used as resistance.

20 Claims, 9 Drawing Sheets

GLUTEUS WEIGHT TRAINING MACHINE

TECHNICAL FIELD

The present invention relates to a weight training machine. More particularly, this invention relates to a resistance rotary weight training machine that trains the gluteus muscles.

BACKGROUND ART

Exercise equipment is used to strengthen, tone, and rehabilitate the human body. Exercise equipment exists in many forms including weight training machines, free weights, elastic bands, and cardio vascular machines (e.g., treadmill, elliptical, bicycle, etc.). Different exercise equipment may be used to isolate and train specific muscles, muscles groups, or areas of the body. Different exercise equipment may also be used to isolate and train the same muscle group or the same bodily area using different movements.

Gluteus weight training machines typically offer little to no rotation of the user's legs when training the gluteus muscles (i.e., gluteus maximus, gluteus medius, and gluteus minimus). Common gluteus weight training machines require the user to perform squatting motions, lunging motions, or leg press motions. These motions indirectly train the gluteus muscles as other muscles such as the user's thigh muscles or quadriceps absorb much of the impact of the motion. As a result, the gluteus muscles are not effectively impacted during these exercises thereby making it more difficult to effectively train the gluteus muscles.

Squats, lunges, and leg press motions also restrict the user's legs to limited extension and flexion movements. These restricted motions create focused points of stress at the knees, hips, and lower back thereby making the user more susceptible to injury at the knees, hips, and lower back.

A further disadvantage of typical gluteus training machines is that the gluteus muscles are not trained in a manner that mimics the muscles' use in sports. For example, running, track and field, basketball, tennis, soccer, etc. require the gluteus muscles to perform rotary movements of the leg. Restricted motions such as squats, lunges, and leg presses do not simulate these movements. As such, typical gluteus weight training machines do not directly develop the gluteus muscles in the manner in which they would be used by athletes to perform the most common sports movements.

Free weight exercises such as the use of free weights in conjunction with leg lunges similarly restrict the motion of the legs, involve other muscle groups, increase stress at critical points (e.g., knees, hips, and lower back), and fail to mimic commonly used motions. Resistance cables have been developed to train the gluteus muscles. However, resistance cables do not control the user's form and have a fixed amount of resistance. As such, resistance cables are not suitable for weight training. Effective weight training requires muscle overloading whereby the user gradually increases the resistance encountered when performing the exercise in order to gradually increase the strength of the muscle.

Accordingly, there is a need in the art for a weight training machine that effectively trains the gluteus muscles through natural movements of the muscles. There is a need for such a machine to provide muscle overloading while reducing the risk of injury to the user.

SUMMARY OF THE INVENTION

Some embodiments provide a weight training machine for training the gluteus muscles (i.e., gluteus maximus, gluteus medius, and gluteus minimus). The gluteus weight training machine of some embodiments provides natural arcing range of motion to isolate and train the gluteus muscles. The weight training machine provides an adjustable weight assembly for progressive overload training of the gluteus muscles. The gluteus weight training machine includes a frame, a support member, and rotating resistance members.

In some embodiments, the frame is composed of a rigid steel structure to provide stability to the gluteus weight training machine. The support member is linked to the frame. The support member provides a backrest against which the user positions his body during exercises. The support member is angled to support the user's body at an angle ranging from 15 to 60 degrees from the ground level with a preferred angle of 45 degrees. In some embodiments, the support member includes sets of hand grips. Each set of hand grips may be attached at different locations along the support member or the frame with a different orientation relative to other sets of hand grips.

In some embodiments, the rotating resistance members are straight or curved lengths of steel, aluminum, or other rigid material. The rotating resistance members attach to the frame via a set of pivot points. Each rotating resistance member rotates about its corresponding pivot point to generate an arcing motion. The arcing motion of the resistance members follows the rotary motion of the human leg. The resistance members provide a user specified amount of resistance to train the gluteus muscles using the rotary motion of the leg.

Each resistance member includes a foot guide and a pad towards a first end of the resistance member and a weight assembly towards a second end of the resistance member that is opposite to the first end. The foot guide positions the leg relative to the pad and maintains the position of the leg throughout the arcing motion of the resistance member. The pad provides a cushion for the user's leg to comfortably press against in order to produce a downward force that is sufficient to overcome the resistance (i.e., upward force) produced by the resistance member and to cause the resistance member to arc downwards. The force applied by the user's leg is generated by the gluteus muscles. As a result the arcing rotation of the resistance member directly isolates and trains the gluteus muscles.

Each resistance member provides resistance that is counter to the user generated downward force (i.e., upwards force) based on an amount of weight that is placed onto the weight assembly of the resistance member. In some embodiments, the weight assembly is a protruding peg upon which different combinations of free weights are placed to specify the amount of resistance. Since the weight assembly is located on the opposite end of the resistance member, any additional weight that is placed onto the weight assembly increases the counter force or resistance against the downward force generated by the user's legs. Therefore, when the downward force applied by the user's leg is sufficient to overcome the resistance, the resistance member arcs downward allowing the user's leg to continue its natural rotary movement. Using the weight assembly, the user is able to overload the gluteus muscles by gradually increasing the amount of resistance as desired.

The length of the resistance members may be adjusted in order to accommodate users of different heights. In some embodiments, each resistance member includes an adjustable knob and multiple holes located lengthwise along the resistance member. The adjustable knob may be used to select and lock the length of the resistance member according to user specifications.

Each resistance member rotates independent of the other resistance member. In some embodiments, the resistance members may be linked together such that the resistance members move together.

BRIEF DESCRIPTION OF THE DRAWINGS

In order to achieve a better understanding of the nature of the present invention a preferred embodiment of the gluteus weight training machine will now be described, by way of example only, with reference to the accompanying drawings in which.

DETAILED DESCRIPTION OF THE INVENTION

In the following detailed description of the invention, numerous details, examples, and embodiments of the gluteus weight training machine are set forth and described. However, it will be clear and apparent to one skilled in the art that the gluteus weight training machine is not limited to the embodiments set forth and that the gluteus weight training machine may be practiced without some of the specific details and examples discussed.

Some embodiments provide a weight training machine for training the gluteus muscles (i.e., gluteus maximus, gluteus medius, and gluteus minimus). The gluteus weight training machine of some embodiments provides natural arcing range of motion to directly train the gluteus muscles with an adjustable weight assembly for progressive overload training of the gluteus muscles.

I. Gluteus Weight Training Machine

Figure 1:
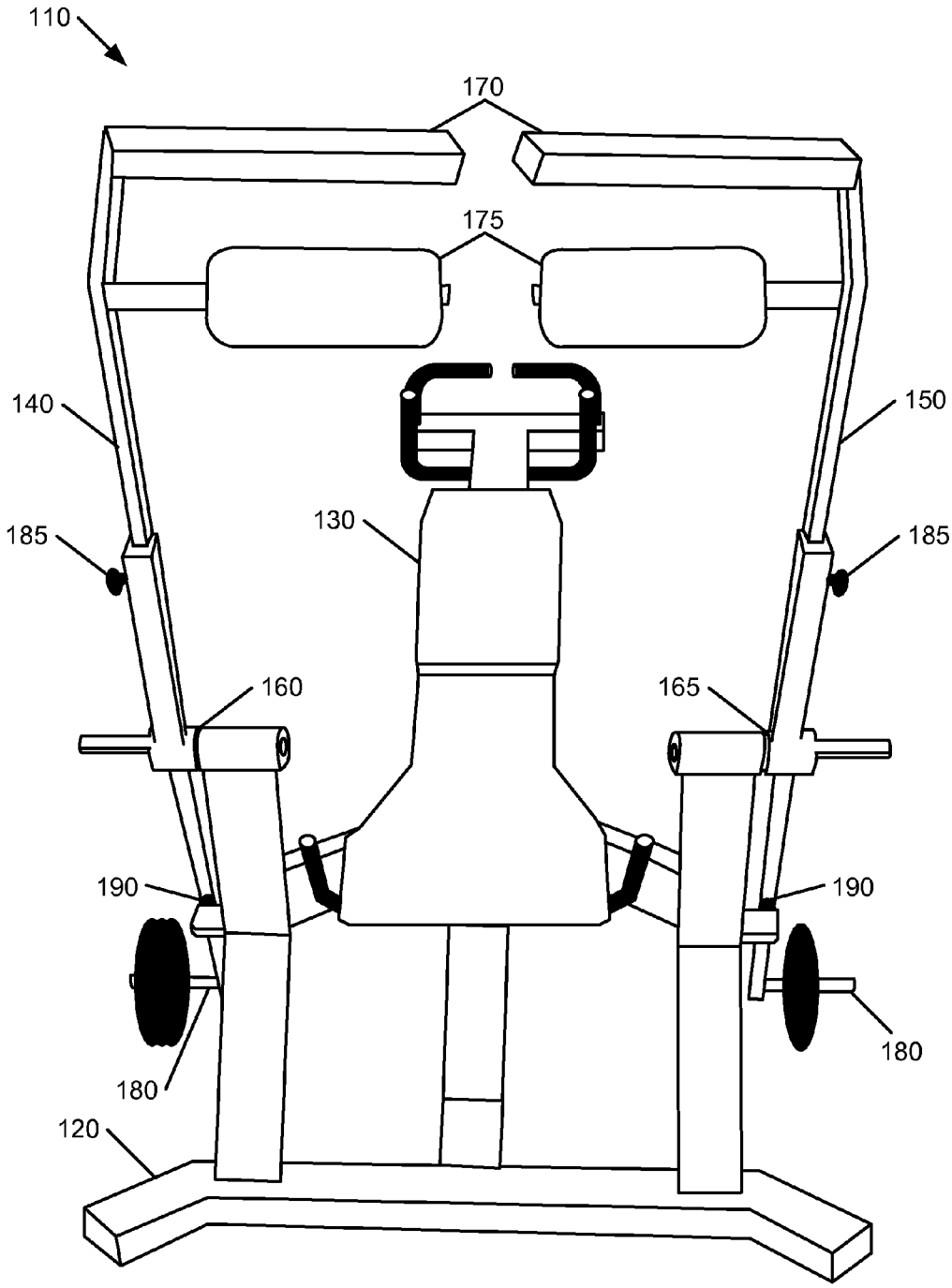
FIG. 1 illustrates a gluteus weight training machine in accordance with some embodiments.

FIG. 1 illustrates a gluteus weight training machine 110 in accordance with some embodiments. The gluteus weight training machine 110 includes a frame 120, a support member 130, and rotating resistance members 140 and 150.

Figure 2:
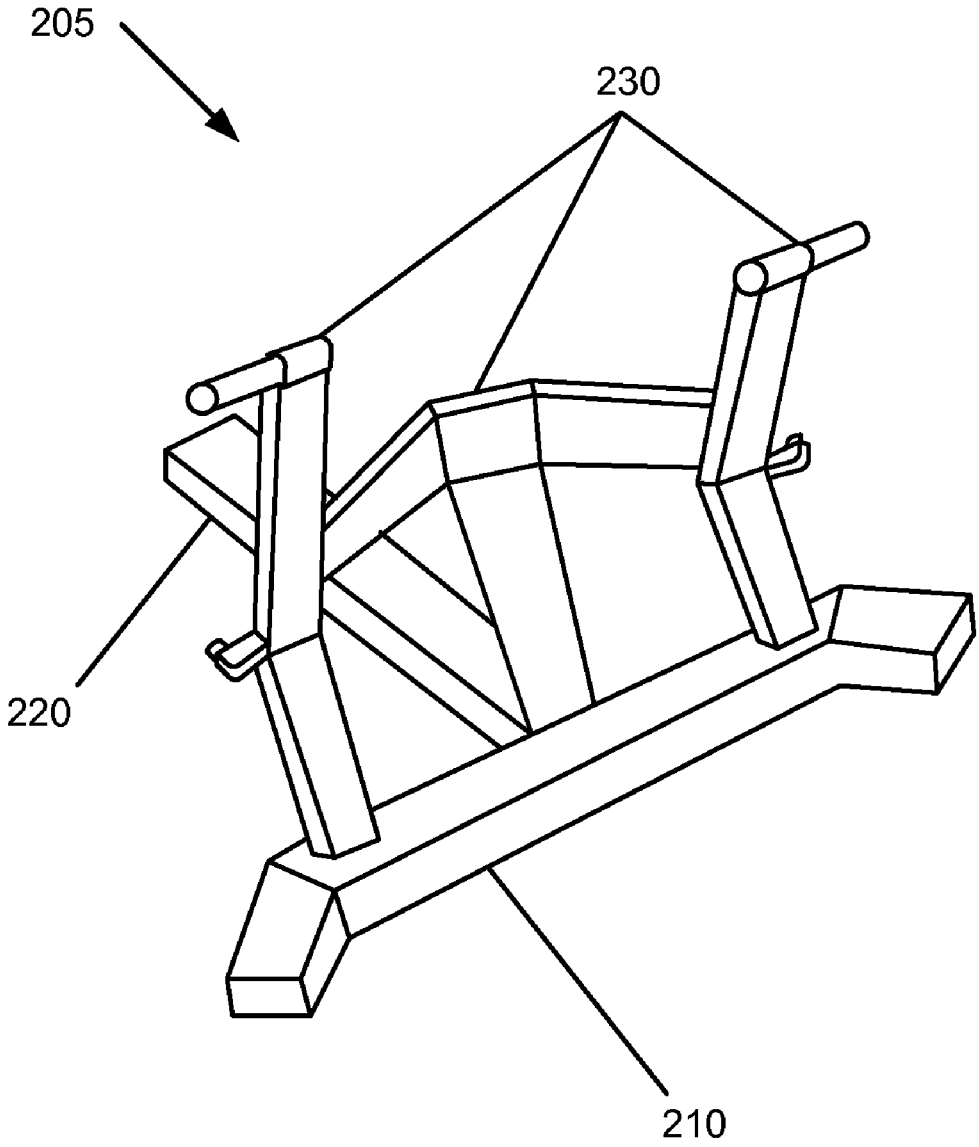
FIG. 2 provides an isolated illustration of the frame in accordance with some embodiments.

The frame 120 stabilizes the weight training machine 110 when engaged by a user to perform gluteus training exercises. FIG. 2 provides an isolated illustration of the frame 120 in accordance with some embodiments.

As shown in FIG. 2, the frame 205 includes: (1) a base with lateral support segments 210 and a longitudinal support segment 220 and (2) vertical support extensions 230. The lateral support segments 210 prevent sideways movement of the machine. The longitudinal support segment 220 is attached to the lateral support segments 210 and the longitudinal support segment 220 prevents the machine from forwards and backwards movement. The vertical support extensions 230 extend vertically from the base to provide a foundation to which the support member 130 and the rotating resistance members 140 and 150 are linked.

In some embodiments, the frame 205 is composed of several steel segments that are welded together. However, it should be apparent to one of ordinary skill in the art that the frame 205 may be composed of any rigid material (e.g., aluminum) in addition to or instead of the aforementioned steel segments.

Figure 3:
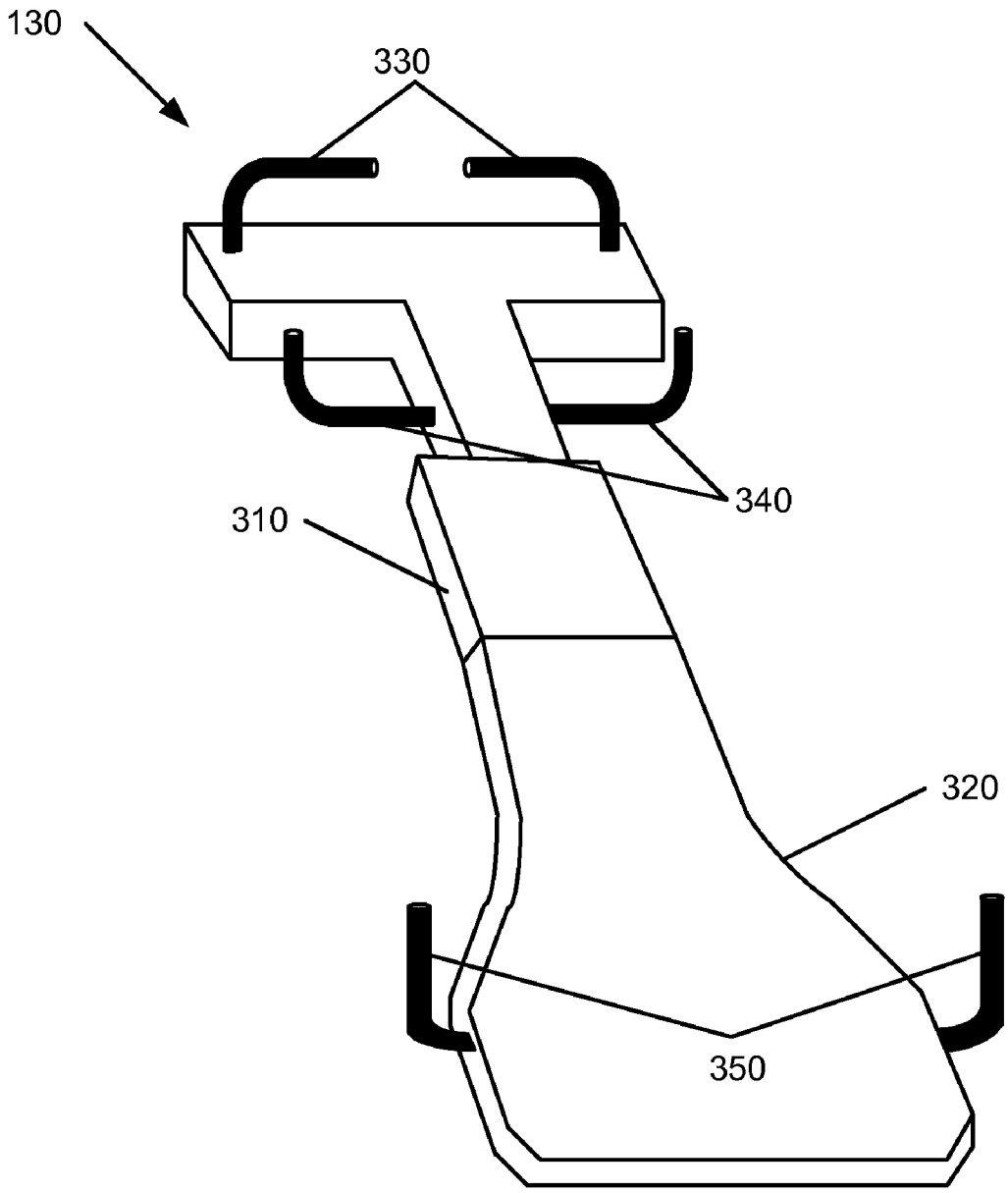
FIG. 3 illustrates the support member in accordance with some embodiments.

The support member 130 couples to a central vertical extension of the frame 120 and provides a backrest against which the user lays in a supine position during use of the machine 110. FIG. 3 illustrates the support member 130 in accordance with some embodiments.

The support member 130 includes an upper back support section 310, a lower back support section 320, and sets of hand grips 330, 340, and 350. The support member 130 may also include a section below the lower back support section 320 that is a seat on which the user sits. In some embodiments, each section of the support member 130 is an upholstered cushion.

The sets of hand grips 330, 340, and 350 are used to maintain body position against the support member 130 during exercises. The sets of hand grips 330, 340, and 350 are positioned at different locations along the support member 130 and may be oriented differently relative to each other. The different positions and orientations of the hand grips 330, 340, and 350 allow the user options with which to maintain the body position as the user's legs follow the arcing trajectory of the resistance members. It should be apparent that in some embodiments the position or orientation of the hand grips 330, 340, and 350 may be set and adjusted by the user.

Figure 4:
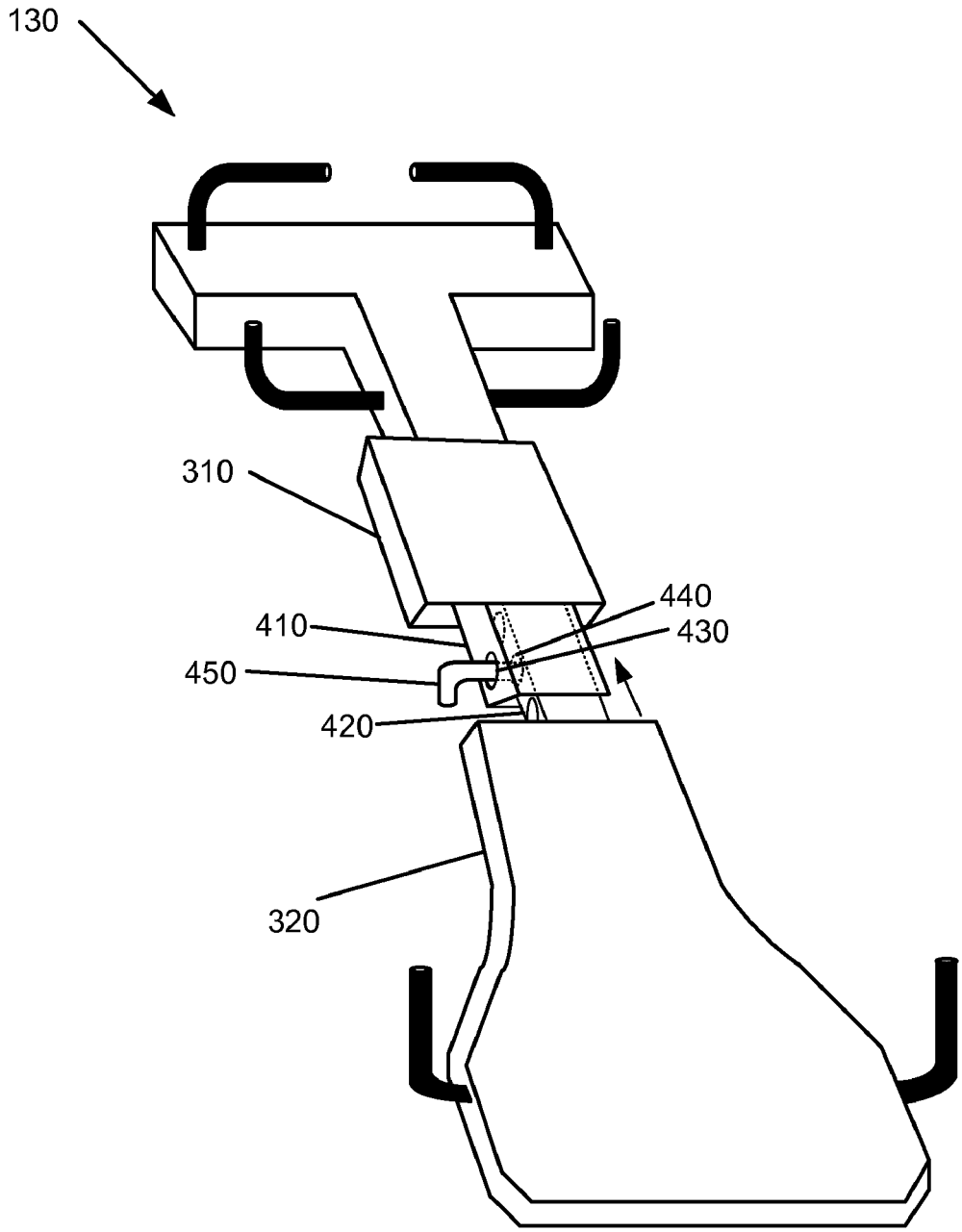
FIG. 4 illustrates an adjustable length support member in accordance with some embodiments.

In some embodiments, the length of the support member 130 is adjustable. As shown in FIG. 4, the lower back support section 320 is coupled to an inner shaft 420 and the upper back support section 310 is coupled to an outer shaft 410 that slides into and out of the inner shaft 420. In this manner, the upper back support section 310 may slide away from the lower back support section 320 in order to increase the length of the support member 130 or slide towards the lower back support section 320 in order to decrease the length of the support member 130. Each shaft 410 and 420 includes one or more predrilled holes 430 and 440 located along an outward facing side of the shaft. Pin 450 secures the length of the support member 130 by sliding through a hole 430 of the outer shaft 410 that is aligned with hole 440 of the inner shaft 420.

With reference back to FIG. 1, the support member 130 couples to the frame 120 such that the support member 130 is angled between 15-60 degrees from the ground level (i.e., 0 degrees) with a preferred angle of 45 degrees. In some embodiments, the angle of the support member 130 is user adjustable. In some such embodiments, the support member 130 couples to the central vertical extension of the frame 120 using a locking hinge mechanism. The user unlocks the hinge by pulling a lever located underneath the support member 130. The user repositions the support member 130 to a preferred angle and releases the lever whereby the position of the support member 130 is locked at the user specified angle.

The bottom of the support member 130 is elevated 3 feet off of the ground level. It should be apparent to one of ordinary skill in the art that in some embodiments the height of the support member 130 is user adjustable and may be repositioned 1-8 feet off of the ground level. Additionally, it should be apparent to one of ordinary skill that the angle of the upper back support section and the angle of the lower back support section of the support member 130 may be user adjustable. In this manner, the support member 130 is able to accommodate users of different heights and body proportions.

The resistance members 140 and 150 are attached to the frame 120 at pivot points 160 and 165. The pivot points 160 and 165 are formed by sliding a solid circular protrusion of the frame 120 into a hollow circular casing or hole within each resistance member 140 and 150. In some embodiments, the resistance members 140 and 150 are made of steel though other rigid materials may also be used in addition to or instead of steel.

Each resistance member 140 and 150 includes a foot guide 170, pad 175, weight assembly 180, and adjustment knob 185. The foot guide 170 and pad 175 are located towards the end of the resistance member that is located in front of the machine 110. In some embodiments, the foot guide 170 is composed of a flat steel sheet and the pad 175 is composed of a cushion. It should be apparent to one of ordinary skill that the foot guide 170 does not have to be flat but may include any voluminous shape and the foot guide 170 may be composed of other rigid materials in addition to or instead of steel.

The user places his foot against the foot guide 170. The foot guide 170 maintains the user's leg position relative to the pad 175. More specifically, when the user places his foot against the foot guide 170, the pad 175 becomes aligned behind the user's heel or ankle. The foot guide 170 prevents the user's foot from extending beyond the position of the guide 170, thereby retaining the heel or ankle in the same position against the pad 175 throughout the full range of the exercise.

The weight assembly 180 allows the user to control the counter-force or resistance that the user encounters when pressing against the pad 175. The weight assembly 180 is located towards the end of the resistance member that is located behind the machine 110. In this manner, the weight assembly 180 functions as a counterweight to the force generated by the user at the pad 175.

In some embodiments, the weight assembly 180 includes a steel peg that protrudes from an outward facing side of the resistance member 140 or 150. Free weights are placed on the weight assembly 180 of each resistance member 140 and 150 to increase resistance and are removed from the weight assembly 180 of each resistance member 140 and 150 to decrease resistance. The user is thereby able to progressively overload the gluteus muscles using the gluteus training machine of some embodiments.

The stop pegs 190 provide a stationary resting position for the resistance members 140 and 150. In some embodiments, each resistance member 140 and 150 includes a balance weight adjacent to or as part of the weight assembly that is used to establish and maintain the stationary position of the resistance member against the stop peg 190 when the gluteus weight training machine is not in use. Specifically, the balance weight is slightly greater than the weight of the foot guide 170 and pad 175 at the opposite end of the resistance member thereby causing the resistance member to rotate towards the stationary position when no additional forces are applied.

Figure 6:
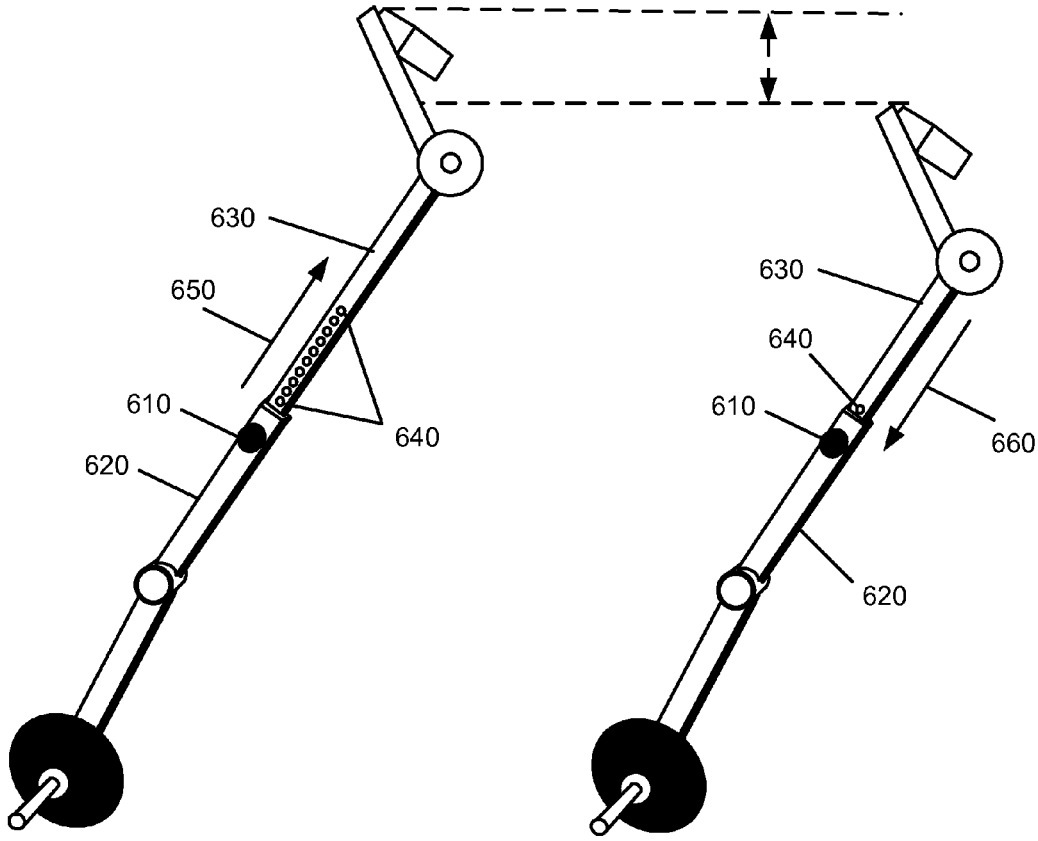
FIG. 6 illustrates using the adjustment knob to adjust the length of a resistance member in accordance with some embodiments.

At the stationary position, adjustments may be made to the amount of resistance placed on the resistance members 140 and 150 or the length of the resistance members 140 and 150 (as further described below with reference to FIG. 6).

Figure 5:
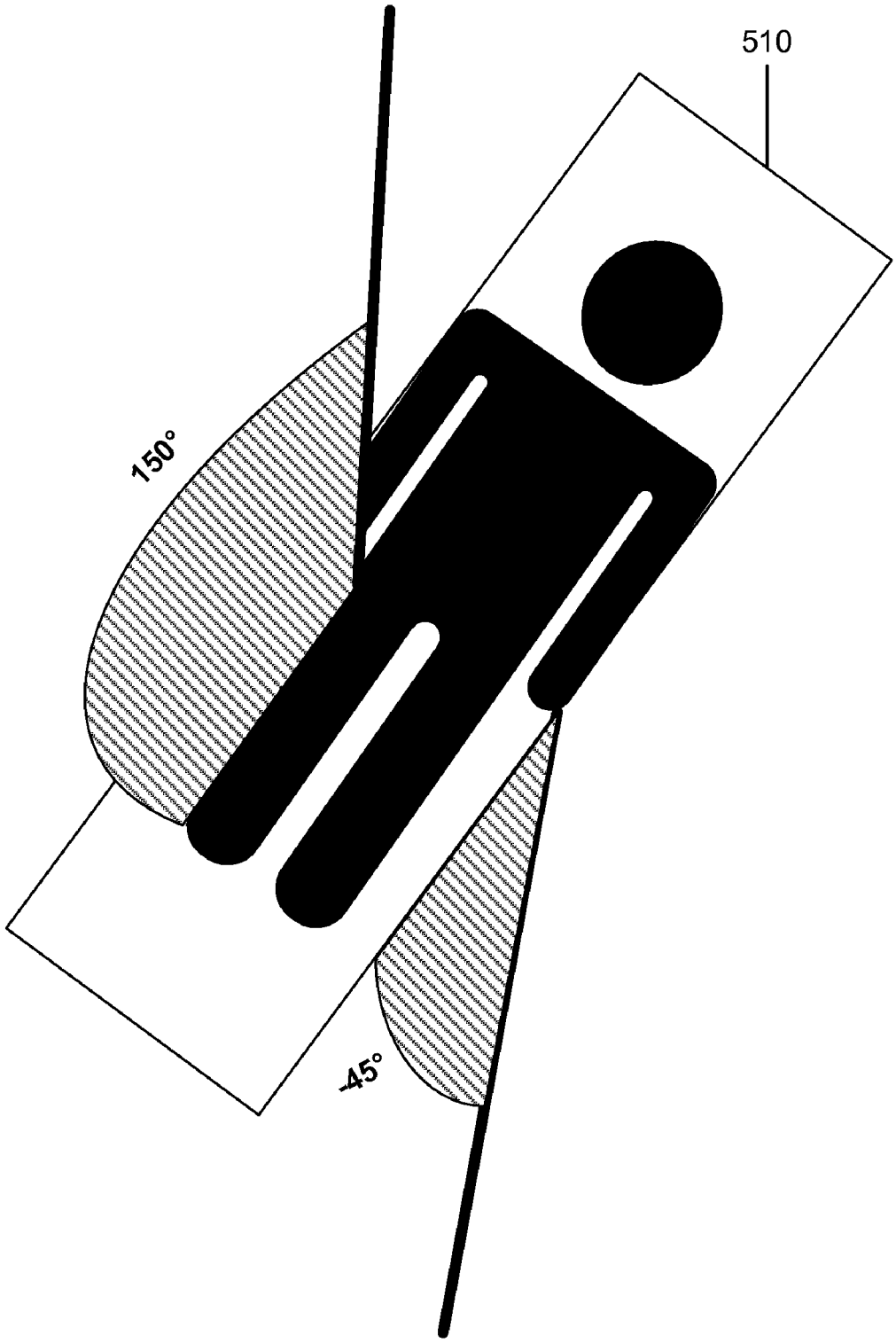
FIG. 5 conceptually illustrates the rotation of the resistance members in accordance with some embodiments.

From the stationary position, the resistance members 140 and 150 of some embodiments rotate up to 195 degrees about the pivot points 160 and 165. In some embodiments, this range of rotation allows the resistance members 140 and 150 to rotate until they come into contact with the ground surface or the frame 120. FIG. 5 conceptually illustrates the rotation of the resistance members in accordance with some embodiments. As shown, the rotation extends up to 150 degrees above the plane of the supine body position of the user 510 and up to 45 degrees below the supine body position of the user 510. In some embodiments, the resistance members rotate greater or less than 150 degrees above the plane of the supine body position of the user 510 and greater or less than 45 degrees below the supine body position of the user 510 based on the length of the resistance members 140 and 150, the height of the support member 130, or the position of the stop pegs 190.

Each resistance member 140 and 150 includes the adjustment knob 185 to adjust the length of the resistance member in order to accommodate users of different heights. FIG. 6 illustrates using the adjustment knob 610 to adjust the length of a resistance member in accordance with some embodiments.

The resistance member includes a main shaft 620, an inner shaft 630, and the adjustment knob 610. Each shaft includes one or more predrilled holes located along an outward facing side of the shaft. As shown in FIG. 6, the main shaft 620 includes a single hole through which the adjustment knob 610 is inserted and the inner shaft 630 includes set of holes 640.

In some embodiments, the adjustment knob 610 is part of a screw mechanism whereby the knob 610 screws into threaded holes within the inner shaft 630 and the main shaft 620 in order to lock the position of the shafts relative to each other. To adjust the height of the resistance member, the user unscrews the adjustment knob 610 from the inner shaft 630. This allows the inner shaft 630 to slide into and out of the main shaft 620 until a desired height is obtained. To increase the length of the resistance member, the user slides the inner shaft 630 out from the main shaft 620 as shown at 650. To decrease the length of the resistance member, the user slides the inner shaft 630 into the main shaft 620 as shown at 660. Once the desired length is obtained, the user screws the adjustment knob 610 so that the adjustment knob 610 passes through a hole of the inner shaft 630 that is aligned with a hole of the main shaft 620. The adjustment knob 610 locks the position of the inner shaft 630 relative to the main shaft 620.

It should be apparent to one of ordinary skill in the art that the adjustment knob 610 may include other means for securing the length of the resistance member. For example, the adjustment knob 610 may include an insertion pin that slides into the holes located along the inner shaft 630 and the main shaft 620.

In some embodiments, each resistance member is a straight segment of metal that is angled 1-45 degrees at the pivot point towards or away the support member. In some embodiments, the angle of the resistance member may be user adjustable in order to provide custom comfort settings for users with different body proportions. By adjusting the angle, the user varies the arcing trajectory of the resistance member in order to suit the user's custom comfort setting. For instance, the user may adjust the angle of the resistance member such that the user's feet are shoulder width distance throughout the arcing trajectory of the resistance members thereby simulating natural foot positioning.

In some embodiments, each resistance member is a curved segment of metal that bends towards or away the user. It should be apparent to one skilled in the art that the upper and lower portions of the resistance members may be straight, curved, angled at the pivot point, not angled at the pivot point, or any combination thereof in order to vary the arcing trajectory of each resistance member according to user specifications.

The resistance members of the gluteus training machine operate independent of one another. The independent operation allows the user to train each leg separately with different amounts of resistance on each leg. In some embodiments, the resistance members may be coupled together. A coupling member links the resistance members together such that the resistance members move in unison.

II. Operation

Figure 7:
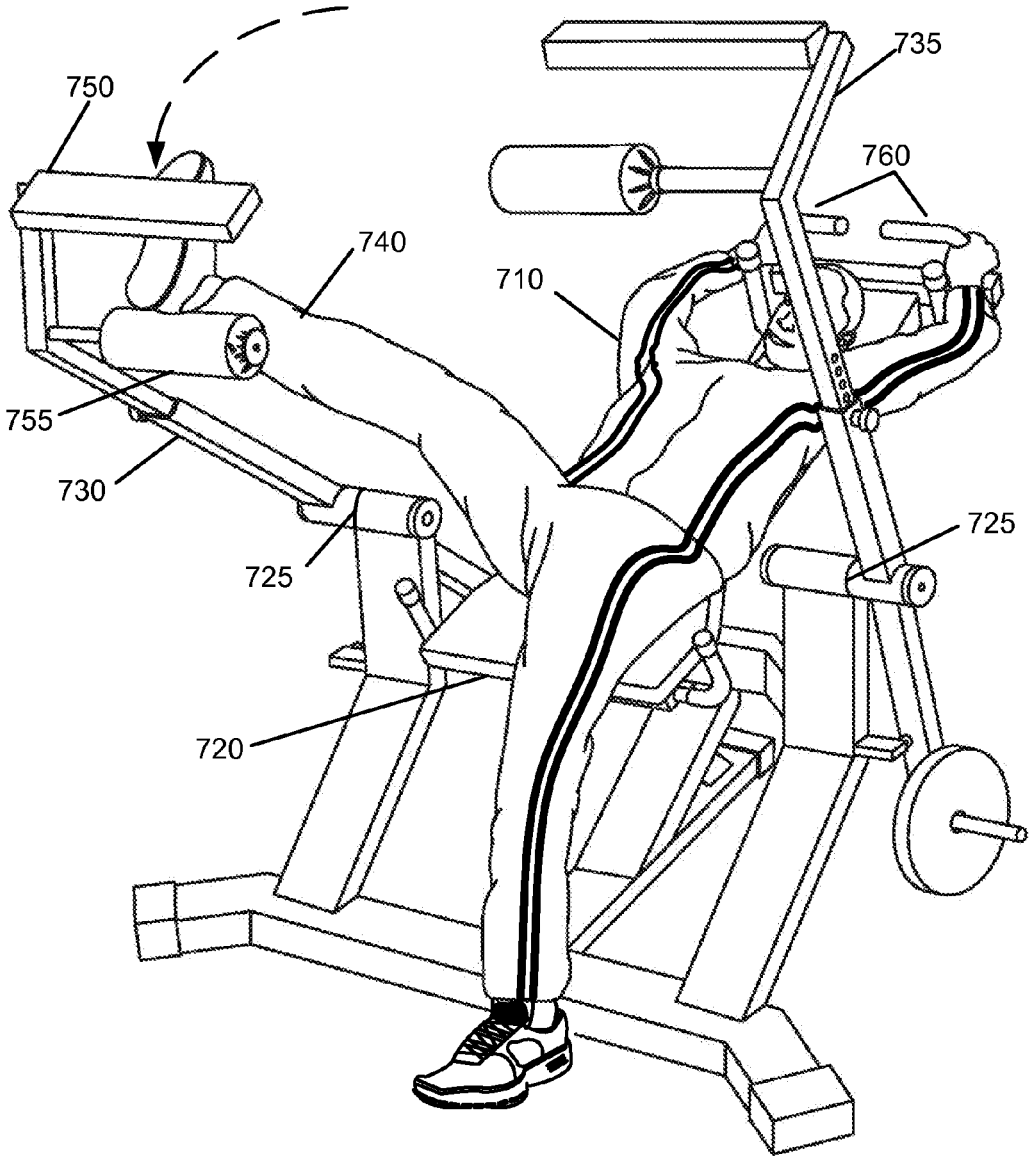
FIGS. 7 and 8 illustrate the arcing range of motion of the machine of some embodiments that isolates and trains the gluteus muscles.
Figure 8:
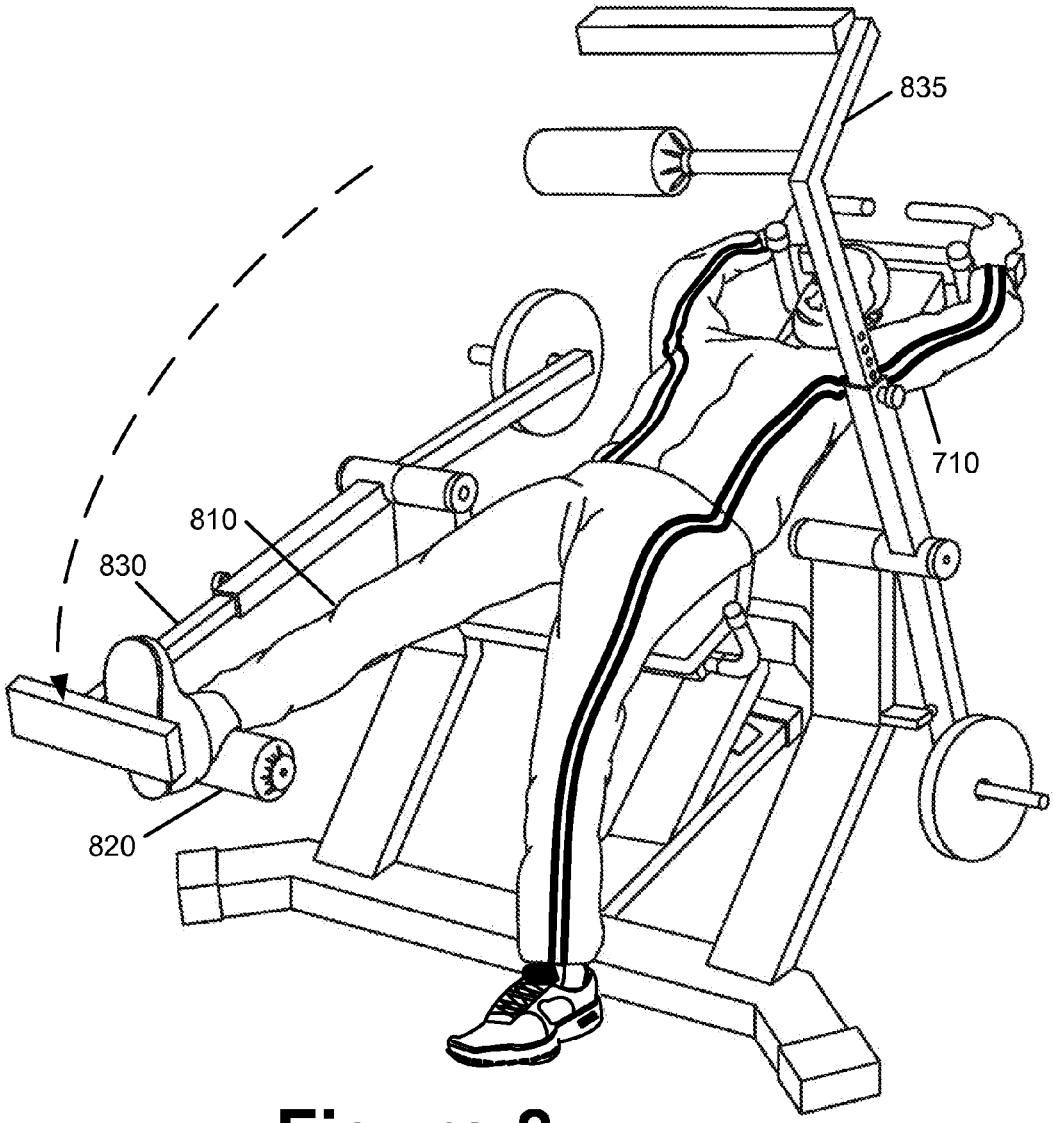
Figure 9:
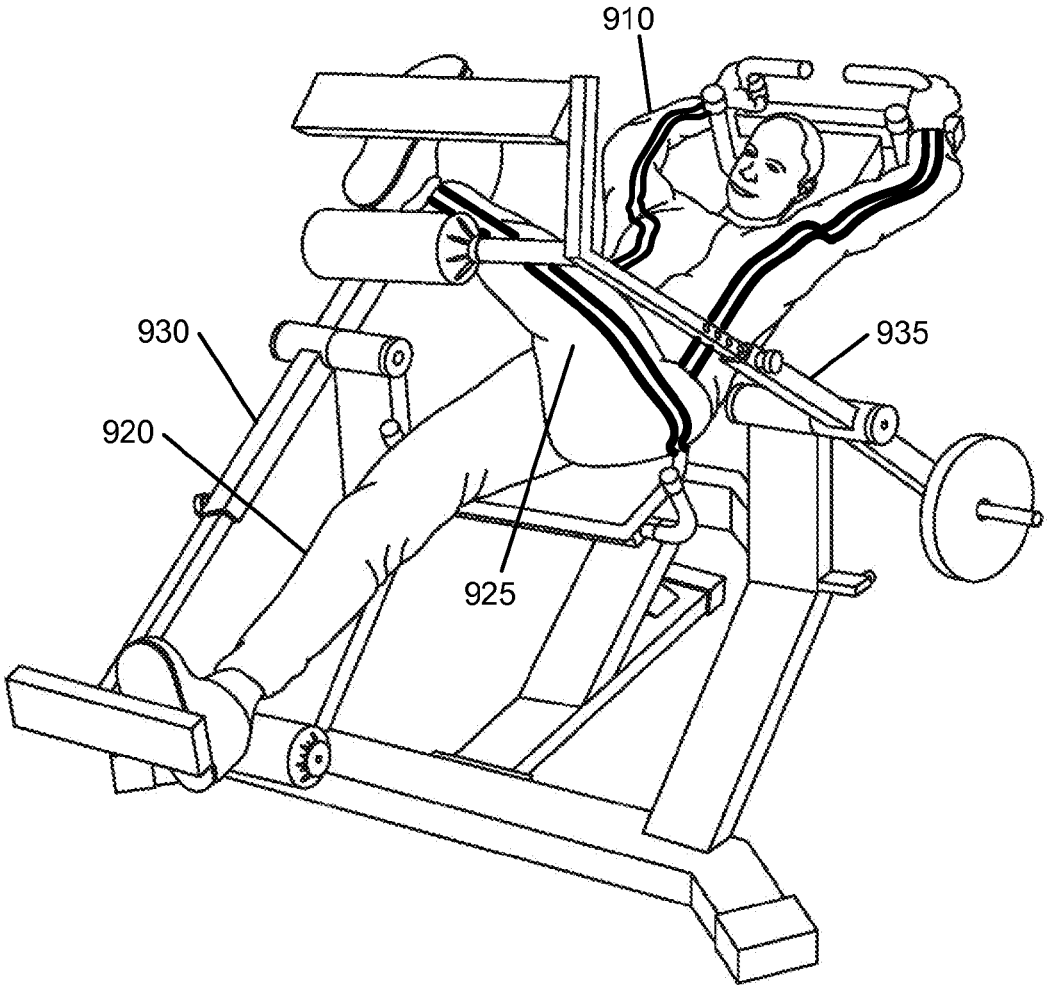
FIG. 9 illustrates the user executing the gluteus training exercises with both legs simultaneously engaged on the resistance members of the machine in accordance with some embodiments.

FIGS. 7-9 illustrate operation of the gluteus training machine in accordance with some embodiments. Specifically, FIGS. 7 and 8 illustrate the arcing range of motion of the machine of some embodiments that isolates and trains the gluteus muscles.

To isolate and train the gluteus muscles, the gluteus weight training machine replicates the natural rotary movements of the human body that directly impact the gluteus muscles. As shown in FIG. 7, the user 710 lays in a supine position against the support member 720 such that the user's hips are in line with the pivot points 725 of the resistance members 730 and 735. In this position, the rotation of the resistance members 730 and 735 is in line with the rotation of the user's leg at the hip joint. The hip joint is a ball and socket joint where the femur (i.e., leg) couples to the pelvis (i.e., hip). By isolating the rotation at the hip joint, the gluteus weight training machine of some embodiments isolates the gluteus muscles which are responsible for the movement of the leg at the hip joint.

To perform the rotary movements that train the gluteus muscles, the user positions his leg 740 against the resistance member 730. The user positions leg 740 such that the user's foot rests against the foot guide 750 with the pad 755 of the resistance member 730 resting behind the user's foot. The user's leg may be fully extended or may have some flexion at the knee. The user stabilizes his body position by grasping hand grips 760.

When the user's leg 740 produces sufficient downward force to overcome the resistance at the weight assembly, the resistance member 730 rotates about its corresponding pivot point creating an arcing trajectory for the user's leg to follow. The arcing trajectory simulates the natural rotation and movement of the user's leg. Stress is distributed over the entire leg thereby lessening stress at the knees, hips, and lower back and reducing the possibility of injury to the knees, hips, and lower back.

Moreover, the force used to overcome the resistance is produced directly by the gluteus muscles. As noted above, the rotation of the resistance member 730 at the pivot point 725 mimics the rotation of the user's leg 740 at the hip joint that is caused by the gluteus muscles. Accordingly, the arcing movement of the resistance member 730 impacts the gluteus muscles directly.

FIG. 8 illustrates the body and leg position of the user 710 from FIG. 7 after performing one repetition of the rotary movement using the gluteus training machine of some embodiments. In FIG. 8, the user's leg 810 is at a resting position similar to if the user was in a vertical standing position. The user determines when to complete the motion based on user preference or user flexibility. Therefore, users are able to complete more or less rotation on the movement. As noted above, the user is able to rotate each resistance member up to 45 degrees below the plane of the supine body position or until the resistance member contacts the ground surface or frame of the gluteus training machine.

When the user 710 reduces the force placed on the pad 820, the counter-force of the resistance member 830 returns the resistance member 830 back to the start position. As with the end position, the start position may be determined by the user based on the user's preference or flexibility. The user may select a start position by reapplying downward force upon the pad of the resistance member once the upward counter-force has returned the resistance member to the desired start position.

The user 710 can perform multiple repetitions of the movements illustrated in FIGS. 7 and 8. Furthermore, the user 710 can progressively overload train the gluteus muscles through increased resistance by adding additional weights to the weight assemblies of the resistance members (e.g., 730, 735, 830 and 835).

FIG. 9 illustrates the user 910 executing the gluteus training exercises with both legs 920 and 925 simultaneously engaged on the resistance members 930 and 935 of the machine in accordance with some embodiments. As before, the user 910 positions his body against the support member with the user's hips aligned to the pivot points of the resistance members 930 and 935. The user 910 places each leg on a resistance member. Each resistance member rotates independent of the other, allowing the user to alternate repetitions between each leg. By alternating repetitions, the user resistance trains the gluteus muscles using a simulated natural running motion. For instance, leg 920 is the current thrusting leg and leg 925 is resetting to perform the subsequent leg thrust in the running motion. Furthermore, the resistance members 930 and 935 may be linked such that the user's legs move in unison with the resistance member 930 and 935.

III. Advantages

The simulated natural motion executed using the gluteus training machine of some embodiments provides several advantages over other gluteus training exercises or machines. Firstly, the arcing motion provided by some embodiments directly isolates and trains the gluteus muscles. Other gluteus machines and exercises that utilize squats, lunges, and leg presses indirectly train the gluteus muscles as other muscles groups, such as the quadriceps, receive much of the exercise impact. The gluteus weight training machine of some embodiments focuses on the force generated at the hip thereby isolating and directly training the gluteus muscles.

Secondly, the gluteus weight training machine of some embodiments provides a full and natural range of motion for the gluteus muscles (e.g., up to 195 degrees). Squat, lunges, and leg presses restrict the range of motion to about 90 degrees of motion. The restricted motion trains less of the muscle and therefore provides less of an impact to the muscle.

Thirdly, squats, lunges, and leg presses focus stress on the knees, hips, and lower back thereby increasing the user's risk of injury. In contrast, the gluteus weight training machine of some embodiments distributes stresses across the entire leg thereby lessening stress and reducing the possibility of injury at the knees, hips, and lower back.

Fourthly, the gluteus weight training machine of some embodiments trains the gluteus muscles using motions that are commonly used in a variety of sports. For example, the arcing rotations of the gluteus weight training machine simulate the motions of a runner and many common movements within basketball, soccer, football, tennis, etc.

While the invention has been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

I claim:

1. A gluteus weight training machine comprising:

a frame comprising (i) a base for stabilizing said machine, (ii) a first support arm with a first pivot point and a first stop peg, and (iii) a second support arm with a second pivot point and second stop peg;

a user backrest that is linearly inclined with respect to a ground surface and that is linked to said frame at a position in between said first and second support arms with a height of the backrest about parallel with a height of the first and second pivot points at a position of said first and second pivot points, and wherein said backrest supports a user's back in an inclined supine position with hips of the user about parallel with said first and second pivot points;

first and second rotating leg resistance members that rotate to emulate rotation of a user leg at the hips, wherein each particular rotating leg resistance member of the first and second rotating leg resistance members comprises:

(i) a pivot point coupler that is located in between a first end and a second end of the particular rotating leg resistance member and that is connected to at least one of said first pivot point of said first support arm and said second pivot of said second support arm for rotation of the particular rotating leg resistance member at a position adjacent to and about a side of the backrest, wherein said first end is at an opposite end of the particular rotating leg resistance member than said second end;

(ii) towards said first end of the particular rotating leg resistance member, a laterally extending bar having a pad against which a user's leg generates sufficient force to overcome an amount of fixed resistance at said second end in order to cause downward arcing rotation of the first end of the particular rotating leg resistance member; and (iii) towards said second end of the particular rotating leg resistance member, a weight assembly for adjusting an amount of weight used as the fixed resistance countering said downward arcing rotation of said first end of the particular rotating leg resistance member, and wherein said second end is weighted greater than said first end to establish a default starting position for the particular rotating leg resistance member with said first end above said first and second pivot points and said second end abutting one of said first and second stop pegs with a position below said first and second pivot points.

2. The gluteus weight training machine of claim 1, wherein said backrest further comprises a set of hand grips at a position at or above a user's head that is used to maintain a user body position when applying said force against at least one of the pads of the first and second rotating leg resistance members.

3. The gluteus weight training machine of claim 2, wherein said set of hand grips comprises a first pair of hand grips vertically extending away from said backrest and a second pair of hand grips horizontally extending towards one another.

4. The gluteus weight training machine of claim 1, wherein each particular rotating leg resistance member further comprises (1) an adjustable knob and (2) a set of holes distributed along a length of the particular rotating leg resistance member, wherein said adjustable knob screws into a particular hole from the set of holes to adjust a length of the particular rotating leg resistance member.

5. The gluteus weight training machine of claim 1, wherein each particular rotating leg resistance member further comprises (1) a pin and (2) a set of holes distributed along a length of the particular rotating leg resistance member, wherein said pin slides into a particular hole from the set of holes to adjust a length of the particular rotating leg resistance member.

6. The gluteus weight training machine of claim 1, wherein said weight assembly comprises a bar and free weights placed on said bar, wherein different combinations of free weights placed on said bar alter the amount of fixed resistance at said second end of the particular rotating leg resistance member.

7. The gluteus weight training machine of claim 1, wherein each particular rotating leg resistance member further comprises a foot guide on which the bottom of a user's foot rests in order to maintain position of the user's leg relative to said pad throughout the arcing downward rotation of the particular rotating leg resistance member.

8. The gluteus weight training machine of claim 1, wherein the first and second rotating leg resistance members rotate independent of one another.

9. The gluteus weight training machine of claim 1, wherein the first and second rotating leg resistance members are coupled together to rotate in unison.

10. The gluteus weight training machine of claim 1, wherein the arcing downward rotation of each rotating leg resistance member follows natural arcing rotation of a human leg at the hips, and wherein said first and second pivot points facilitate said natural arcing rotation of the rotating leg resistance members.

11. The gluteus weight training machine of claim 1, wherein said backrest is for maintaining body positioning of the user in a linearly inclined supine position during usage of the gluteus weight training machine.

12. The gluteus weight training machine of claim 1, wherein said backrest comprises at least one user adjustment setting for adjusting at least one of a length, height, and angle of said backrest, wherein said angle adjusts 15-60 degrees from the ground level.

13. An apparatus comprising:

a frame comprising (i) a user backrest to maintain body positioning of a user in an upwards facing linearly inclined position during usage of the apparatus and (ii) a support adjacent to and about a side of said backrest comprising a pivot point elevated to be about parallel to said backrest at a position of said pivot point; and at least one arm coupled to said pivot point for rotating about said pivot point in an arcing trajectory that emulates rotation of a user leg at the hips, wherein said arm is further for providing an adjustable amount of resistance against an arcing downward rotation of said arm about said pivot point, said arm comprising:

(i) a first end with a pad laterally extending from the arm; and (ii) a second end opposite to the first end bearing a user specifiable amount of free weight used as said resistance against said arcing downward rotation of said arm, and wherein said second end is weighted greater than the first end to establish a default starting position for said arm with said arm diagonally inclined with said first end positioned in front and above said backrest and with said second end positioned behind and below said backrest, and wherein the user applies force at the first end of said arm primarily using gluteus muscles of the user's leg to overcome the adjustable amount of resistance countering the arcing downward rotation.

14. The apparatus of claim 13, wherein the apparatus is a resistance weight training machine for training the gluteus muscles.

15. The apparatus of claim 13, wherein said arm comprises a first shaft and a second shaft, wherein the first shaft slides into and out of the second shaft in order to adjust the length of the arm, and wherein the first end of the arm is located at an end of the first shaft and the second end of the arm is located at an end of the second shaft.

16. The apparatus of claim 15, wherein the second shaft comprises a weight assembly towards the second end of said arm for supporting various amounts of weight used to determine the amount of resistance provided by said arm.

17. The apparatus of claim 15, wherein the second shaft comprises at least one hole and the first shaft comprises a set of holes, wherein said arm further comprises an adjustable member that inserts into a hole of the set of holes of the first shaft that is aligned with the hole of the second shaft to specify a length of the arm.

18. A method of training the gluteus muscles, the method comprising:

providing a weight training machine comprising a frame, a backrest, and a set of rotating leg resistance members that move in a downward arcing motion when sufficient force is applied to overcome resistance countering said downward arcing motion;

establishing a diagonally inclined default initial position for each rotating leg resistance member of the set of rotating leg resistance members with a first end of each rotating leg resistance member having a default initial position in front and above said backrest and with a second end of each rotating leg resistance member having a default initial position behind and below said backrest, wherein said default initial position is established by weighting the second end greater than the first end;

adjusting an amount of weight placed on said second end of each of the set rotating leg resistance members to set the resistance countering said downward arcing motion, wherein said second end is at an opposite end of the rotating leg resistance member than the first end; and executing downward arcing movements of the rotating leg resistance members when sufficient force is applied by a user's legs to overcome the set resistance, wherein said downward arcing movements isolate and train the gluteus muscles of the user's legs.

19. The method of claim 18 further comprising providing a pad at the first end of each rotating leg resistance member against which to place a user foot in order to generate said sufficient force to overcome the set resistance and cause said downward arcing movements.

20. The method of claim 18 further comprising providing a set of hand grips on the backrest for maintaining body position during usage of said weight training machine.

* * * * *